US010591262B1

(12) United States Patent
Osborn et al.

(10) Patent No.: US 10,591,262 B1
(45) Date of Patent: Mar. 17, 2020

(54) BROADHEAD ARROW

(71) Applicant: 406 Archery LLC, Deer Lodge, MT (US)

(72) Inventors: Patrick B. Osborn, Oceanside, CA (US); Ron R. McCracken, Kingman, AZ (US); David A. McCracken, Vista, CA (US)

( * ) Notice: Subject to any disclaimer, the term of this patent is extended or adjusted under 35 U.S.C. 154(b) by 0 days.

(21) Appl. No.: 16/403,568

(22) Filed: May 5, 2019

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 4,976,443 | A | 12/1990 | DeLucia | |
| 5,090,709 | A | 2/1992 | Johnson | |
| 5,102,147 | A | 4/1992 | Szeluga | |
| 5,178,398 | A | 1/1993 | Eddy | |
| D342,303 | S | 12/1993 | Johnson | |
| D363,108 | S | 10/1995 | Johnson | |
| 5,458,341 | A | 10/1995 | Forrest et al. | |
| 5,820,498 | A * | 10/1998 | Maleski | F42B 6/08 473/584 |
| 5,879,252 | A | 3/1999 | Johnson | |
| 6,428,434 | B1 | 8/2002 | Liechty, II | |
| 7,311,621 | B2 | 12/2007 | Sullivan et al. | |
| 8,435,144 | B2 | 5/2013 | Asherman | |
| 9,303,962 | B1 | 4/2016 | Burnworth et al. | |
| 9,303,963 | B1 | 4/2016 | Ford | |
| 9,417,039 | B2 | 8/2016 | Rowley | |
| 9,857,153 | B1 | 1/2018 | Redline | |
| 9,879,955 | B2 | 1/2018 | Rowley | |
| 2002/0065155 | A1 | 5/2002 | Liechty, II | |
| 2002/0098926 | A1 | 7/2002 | Liechty, II | |
| 2006/0154757 | A1 | 7/2006 | Sullivan et al. | |
| 2012/0231907 | A1 | 9/2012 | Asherman | |
| 2016/0195376 | A1 | 7/2016 | Rowley | |
| 2016/0349024 | A1 | 12/2016 | Rowley | |
| 2017/0184381 | A1 | 6/2017 | Loa | |
| 2018/0245892 | A1 | 8/2018 | Haas | |

* cited by examiner

*Primary Examiner* — John A Ricci
(74) *Attorney, Agent, or Firm* — Antoinette M. Tease

(57) ABSTRACT

A broadhead arrow having an arrowhead body with a threaded proximal end and a pointed distal end, a circumferential receptacle that is situated between the proximal and distal ends of the arrowhead body and configured to receive a retention ring, a plurality of blades, each blade having a serrated outer edge and a razor sharp inner edge, and a tapered shaft that extends from a center of the retention ring to the pointed distal end. Each blade is rotatably attached to the retention ring and has a trigger arm that is located at a base of the blade. The shaft has a plurality of longitudinally extending slots configured to receive the inner edges of the blades. The receptacle has a number of longitudinally extending slots that are configured to allow the blades to rotate outwardly on the retention ring.

19 Claims, 11 Drawing Sheets

BROADHEAD ARROW

BACKGROUND OF THE INVENTION

1. Field of the Invention

The present invention relates generally to the field of archery, and more specifically, to a broadhead arrow with three pivoting blades, each of which has a scalloped outer edge and a razor sharp inner edge.

2. Description of the Related Art

Bow hunters need an effective and lethal arrow shaft tip that will not merely wound the animal. Recent statistics suggest an average bowhunting wounding rate of over 50%. The effectiveness of an arrow tip depends in significant part on the shape, configuration and number of arrow blades, all of which must be engineered to provide overall arrow stability and desired flight characteristics. Existing arrowheads exhibit unstable and unpredictable flight characteristics.

A broadhead arrowhead is one that has two to four sharp blades attached to it. In order to be effective, the broadhead must cut major blood vessels, thoracic organs, or the neurological center to cause a quick death. Mechanical broadheads provide a wider cutting surface than fixed blade broadheads due to the opening motion of the arrow blades, which typically pivot outwardly from a shaft upon impact. The following patent references pertain to mechanical broadheads.

U.S. Pat. No. 4,976,443 (DeLucia, 1990) provides a mechanical broadhead in which the blades, which have only internal cutting edges, are configured to retract when withdrawn from game. The arrowhead has two opposing pairs of blades, each attached to the arrowhead body with a punching slide pin. The arrowhead tip has a graduated punch step configuration.

U.S. Pat. No. 5,090,709 (Johnson, 1992) discloses an arrowhead with both fixed and extendable blades. The extending blades are pivotally connected to the arrowhead body with pins, and a ring releasably holds the extendable blades in slots in the tubular arrowhead body.

U.S. Pat. No. 5,102,147 (Szeluga, 1992) provides a broadhead assembly in which a pair of blades is pivotably mounted on an actuating plunger with a pin. Each blade has a sharpened, rectilinear inner edge (referred to as the "outer" edge in the patent due to the fact that this edge faces outwardly when the blades are in an open position) and a profiled outer edge (referred to as the "inner" edge in the patent because this edge faces inwardly when the blades are in a fully extended position). The profiled outer edge of the blade has two rectilinear sections, one of which extends radially with respect to the center of the blade aperture and diverges rearwardly with respect to the sharpened inner edge, and the other of which is contiguous to the first section and extends rearwardly therefrom in a converging relationship to the inner edge. Each blade also has a lobe-like portion with a curvilinear edge.

U.S. Pat. No. 5,178,398 (Eddy, 1993) discloses with two pivotal blades, each of which has a rearwardly located outwardly protruding spur that engages the animal's hide, thereby causing the blades to rotate. Each blade has a sharpened edge and a partially chamfered or beveled (not sharpened) edge. The sharpened edge is preferably slightly arcuate or concave along its length. The protruding spurs prevent the blades from over-rotating. The blades are situated within an elongated slot formed in the arrowhead body and attached to the body with a pin.

U.S. Pat. Nos. D342303 (Johnson, 1993) and D363108 (Johnson, 1993) illustrate a broadhead with three expandable blades restrained by a resilient O-ring.

U.S. Pat. No. 5,458,341 (Forrest et al., 1995) provides a broadhead arrow tip with a tapered main body, two pivoting angled blades with inner cutting edges, and two fixed blades. The pivoting blades comprise shorter legs with cutting edges that are exposed during flight.

U.S. Pat. No. 5,879,252 (Johnson, 1999) discloses a broadhead arrowhead with a plurality of pivoting sharpened blades, each of which is connected to the main body with a pin. The arrowhead tip comprises a pyramid-like shaped nose with adjacent intersecting surface that taper forwardly to a penetrating point.

U.S. Patent Application Pub. No. 20020065155 (Liechty, H) provides a mechanical broadhead in which the pivoting blades are both removable and replaceable. The arrowhead is structured so that the inner cutting blades do not come into contact with the arrowhead body when the blades are in a closed position. Specifically, a spacer element prevents the inner edge of the blades from being dulled by contact with the arrowhead body. In at least one embodiment, the blades are attached to the arrowhead body with an annular blade ring. The blades have only a single inner cutting edge.

U.S. Pat. No. 6,428,434 (Liechty, II, 2002) discloses an arrowhead with a pivotal blade rotatably mounted to the arrowhead body so that the blade is positioned at different cutting diameters when in different penetrating configurations. The hinge structure can be positioned at different spatial locations relative to the arrowhead body. In the described embodiments, the arrowhead has three or four blades, each of which has an inner cutting edge only (that is, the cutting edge is exposed only when the blade pivots outwardly). In a preferred embodiment, the stationary end of each blade is coupled to a blade ring that is slidably mounted within a recessed annular groove in the arrowhead body.

U.S. Pat. No. 6,758,774 (Liechty, II, 2004) provides a broadhead arrowhead with a recessed collar that is slidably positionable about the arrowhead stem or shaft. A washer has a central through hole and an internally recessed circular void. The through hole of the washer is disposed about the stem when the washer is attached to the body, and the circular void of the washer faces open toward the forward end of the arrowhead. In one embodiment, the blades pivot about an annular hinge pin. The blades have only a single inner cutting edge.

U.S. Pat. No. 8,435,144 (Asherman, 2013) discloses a blade system for a projectile in which at least one blade is pivotally secured to the body and has an outer cutting edge and an inner cutting edge. The blades also has a lever proximate to a rear portion of the blade. The lever serves to pivot the blade from a closed position to an open position. The lever has an unsharpened leading edge to prevent cutting of the target animal tissue.

U.S. Pat. No. 9,303,962 (Burnworth et al., 2016) provides an expanding broadhead with at least one expanding barb unit, a rear retention ring and a front retention ring. Each expanding barb unit includes two barb elements that extend from a base ring. Each barb element includes a lengthwise barb base, a first set of opposing barbs, a second set of opposing barbs, and opposing bulges. The two lengthwise barb bases are bent to obtuse angles, and the base ring of the expanding barb unit is bent into a substantially semi-circular shape.

U.S. Pat. No. 9,303,963 (Ford, 2016) discloses a mechanical broadhead with a plurality of cutting blades pivotally mounted to the elongated body. Each cutting blade has a minor cutting edge, a major cutting edge, and a grab hook at the distal end of the minor cutting edge. The major cutting edge is received within a longitudinally extending slot when the blade is in a folded position, and the minor cutting edge and major cutting edge define an acute angle between them.

U.S. Pat. No. 9,417,039 (Rowley, 2016) and U.S. Pat. No. 9,879,955 (Rowley, 2018) provide a broadhead arrow with an elongated ferrule and a blade. The ferrule has a forward tip and an aft shank that connects the broadhead to an arrow shaft. The blade is fitably mounted relative to the ferrule to shift into and out of a retracted position. The blade extends forwardly beyond the ferrule tip in the retracted position so that the blade forms the leading tip of the broadhead.

U.S. Patent Application Pub. No. 20170184381 (Loa) discloses a broadhead system with a pivoting blade. The blade resides within a notch in the arrow body and is attached to the body with a pivoting member. The invention is shown as having a fixed blade at the arrow tip and two pivoting blades.

U.S. Pat. No. 9,857,153 (Redline, 2018) provides a broadhead with two pairs of opposing pivoting blades, one situated forwardly of the other along the arrowhead body. The forward-most pair of blades are the cutting blades, and the rearward-most pair of blades are trigger blades that activate the cutting blades. A movable ring is slidably movable between a flight configuration positioned proximate to the front end of the body and an actuated configuration displaced from the front end that actuates the trigger blades to move the dynamic blades to an extended position. Two fixed blades are mounted toward the bottom end of the arrowhead body.

U.S. Patent Application Pub. No. 20180245892 (Haas) discloses a retainer for broadhead blades in the form of a collar. A first biasing force exerted by the collar on the retention region retains the blade in a retracted position, and a second biasing force exerted by the collar on the deployment region retains the blade in a first deployed position.

BRIEF SUMMARY OF THE INVENTION

The present invention is a broadhead arrow comprising: an arrowhead body with a threaded proximal end and a pointed distal end; a circumferential receptacle that is situated between the proximal and distal ends of the arrowhead body and configured to receive a retention ring; a plurality of blades, each blade having a serrated outer edge and a razor sharp inner edge; and a tapered shaft that extends from a center of the retention ring to the pointed distal end; wherein each blade is rotatably attached to the retention ring; wherein each blade comprises a trigger arm that is located at a base of the blade; wherein the shaft comprises a plurality of longitudinally extending slots configured to receive the inner edges of the blades; and wherein the receptacle comprises a number of longitudinally extending slots that are configured to allow the blades to rotate outwardly on the retention ring. In a preferred embodiment, the serrated outer edge of each blade comprises a plurality of teeth. Each trigger arm preferably comprises a straight bottom edge, a tip, and an arcuate trough that extends from the tip of the trigger arm to a base of the outer edge of the blade.

In a preferred embodiment, the proximal end of the arrowhead body is threaded; the arrowhead body further comprises a first raised step and a second raised step; each of the first raised step and the second raised step has an outer diameter; the outer diameter of the second raised step is greater than the outer diameter of the first raised step; the first raised step is situated between the threaded proximal end and the second raised step; and wherein the second raised step terminates in the circumferential receptacle. Preferably, each blade has a tip; each blade has a width; and the width of each blade is tapered so that the blade is wider at the base of the blade than at the tip of the blade. Each longitudinally extending slot in the shaft preferably extends from a base of the shaft at the retention ring to the pointed distal end of the arrowhead body.

In a preferred embodiment, the arrowhead body has a leading edge; the pointed distal end of the arrowhead body has a proximal end and a distal end; and each blade terminates short of the proximal end of the pointed distal end of the arrowhead body so that the pointed distal end of the arrowhead body is the leading edge of the arrowhead body. Preferably, each blade comprises a rounded bottom end with a hole through which the retention ring extends.

In a preferred embodiment, the bottom edge of the trigger arm is at a constant forty-five degree angle relative to the inner edge of the blade. In another preferred embodiment, each blade has a width that decreases from the base of the blade to the tip of the blade; there is an angle between the bottom edge of the trigger arm and a longitudinal axis of the outer edge of the blade; and the angle between the bottom edge of the trigger arm and the longitudinal axis of the outer edge of the blade increases from the base of the blade to the tip of the blade as the width of the blade decreases and the blade tapers to a point.

In an alternate embodiment, the present invention is a broadhead arrow comprising: an arrowhead body with a threaded proximal end and a pointed distal end; a circumferential receptacle that is situated between the proximal and distal ends of the arrowhead body and configured to receive a retention ring; a plurality of blades, each blade having an outer edge and an inner edge; and a tapered shaft that extends from a center of the retention ring to the pointed distal end; wherein each blade is rotatably attached to the retention ring; wherein each blade comprises a trigger arm that is located at a base of the blade; wherein the shaft comprises a plurality of longitudinally extending slots configured to receive the inner edges of the blades; and wherein the receptacle comprises a number of longitudinally extending slots that are configured to allow the blades to rotate outwardly on the retention ring. Each trigger arm preferably comprises a straight bottom edge, a tip, and an arcuate trough that extends from the tip of the trigger arm to a base of the outer edge of the blade.

In a preferred embodiment, the proximal end of the arrowhead body is threaded; the arrowhead body further comprises a first raised step and a second raised step; each of the first raised step and the second raised step has an outer diameter; the outer diameter of the second raised step is greater than the outer diameter of the first raised step; the first raised step is situated between the threaded proximal end and the second raised step; and the second raised step terminates in the circumferential receptacle. Preferably, each blade has a tip, each blade has a width, and the width of each blade is tapered so that the blade is wider at the base of the blade than at the tip of the blade. Each longitudinally extending slot in the shaft preferably extends from a base of the shaft at the retention ring to the pointed distal end of the arrowhead body.

In a preferred embodiment, the arrowhead body has a leading edge; the pointed distal end of the arrowhead body has a proximal end and a distal end; and each blade terminates short of the proximal end of the pointed distal end of the arrowhead body so that the pointed distal end of the arrowhead body is the leading edge of the arrowhead body. Preferably, each blade comprises a rounded bottom end with a hole through which the retention ring extends.

In a preferred embodiment, the bottom edge of the trigger arm is at a constant forty-five degree angle relative to the inner edge of the blade. In another preferred embodiment, each blade has a width that decreases from the base of the blade to the tip of the blade; there is an angle between the bottom edge of the trigger arm and a longitudinal axis of the outer edge of the blade; and the angle between the bottom edge of the trigger arm and the longitudinal axis of the outer edge of the blade increases from the base of the blade to the tip of the blade as the width of the blade decreases and the blade tapers to a point.

REFERENCE NUMBERS

Figure 1:
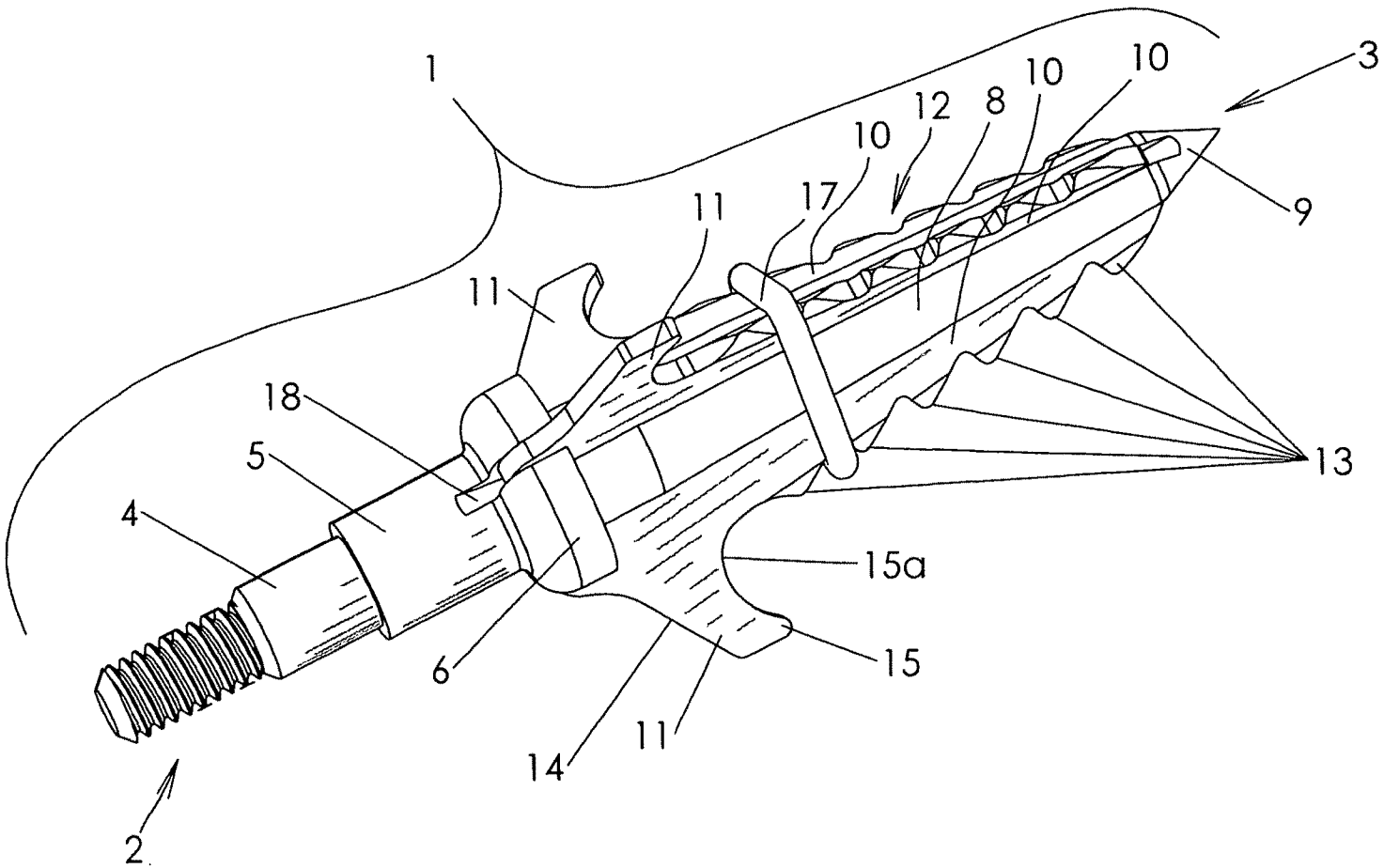
FIG. 1 is a perspective view of the present invention with the blades in a closed position.

1 Arrowhead body
2 Proximal end (of arrowhead body)
3 Distal end (of arrowhead body)
4 First step
5 Second step
6 Receptacle
7 Retention ring
8 Tapered shaft
9 Pointed tip
10 Arrow blade
11 Trigger arm
12 Outer edge (of blade)
13 Teeth
14 Bottom edge (of trigger arm)
15 Tip (of trigger arm)
15*a* Trough (of trigger arm)
16 Inner edge (of blade)
17 Elastic band
18 Slot (in receptacle)
19 Slot (in shaft)
20 Rounded end (of blade)
21 Hole (in rounded end of blade)
22 Gap (in retention ring)

DETAILED DESCRIPTION OF INVENTION

FIG. 1 is a perspective view of the present invention with the blades in a closed position. As shown in this figure, the present invention is an arrowhead body 1 comprised of a threaded proximal end 2 and a pointed distal end 3. Adjacent to the threaded proximal end 2 is a first raised step 4. The first raised step 4 is situated between the threaded proximal end 2 and a second raised step 5. The second raised step 5 terminates in a circumferential receptacle 6 that is configured to receive the retention ring 7 (see FIG. 5). A tapered shaft 8 extends from the center of the retention ring 7 to the pointed tip 9 of the distal end 3 of the arrowhead body 1.

Figure 5:
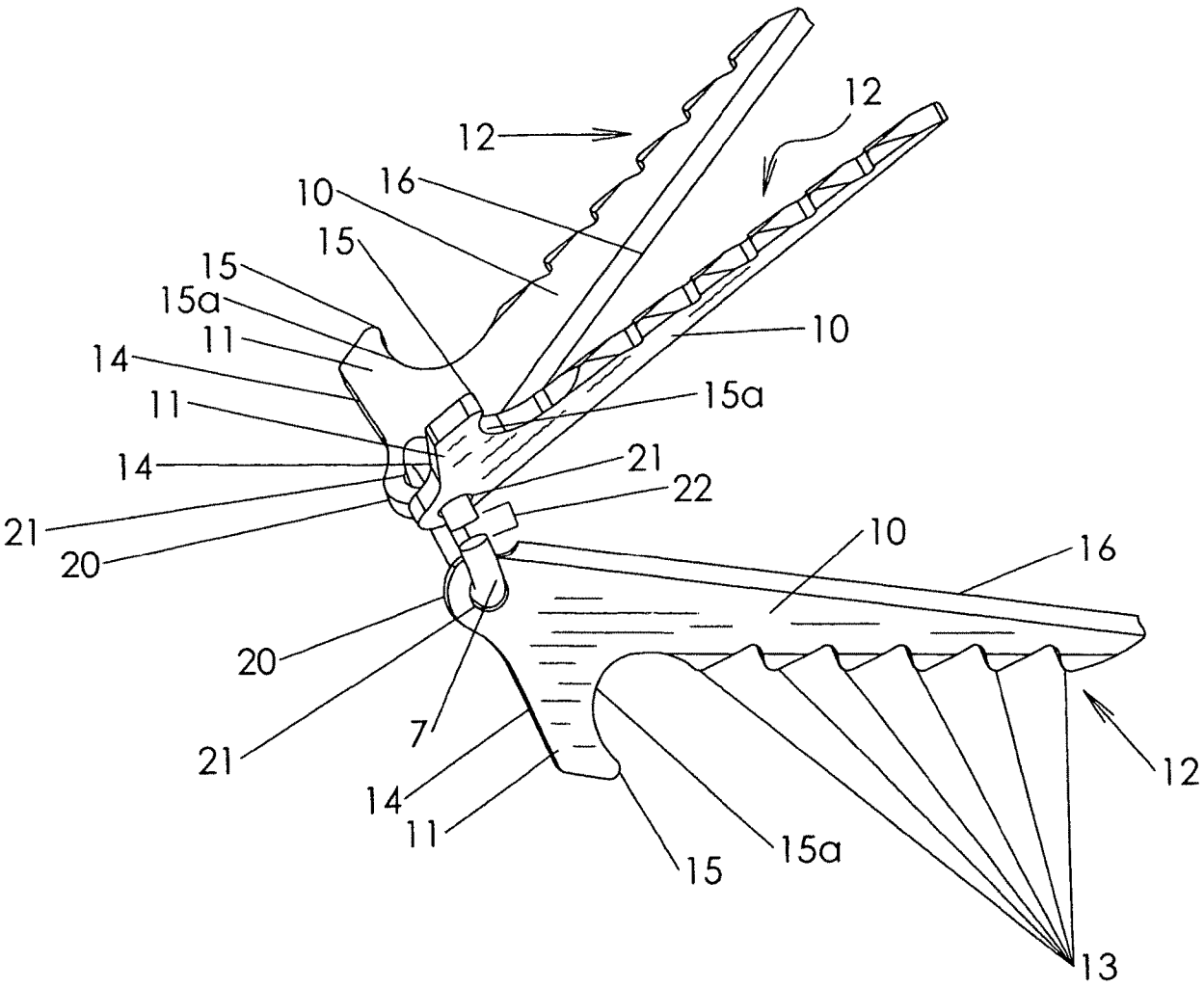
FIG. 5 is a perspective view of the arrow blades and retention ring of the present invention.
Figure 10:
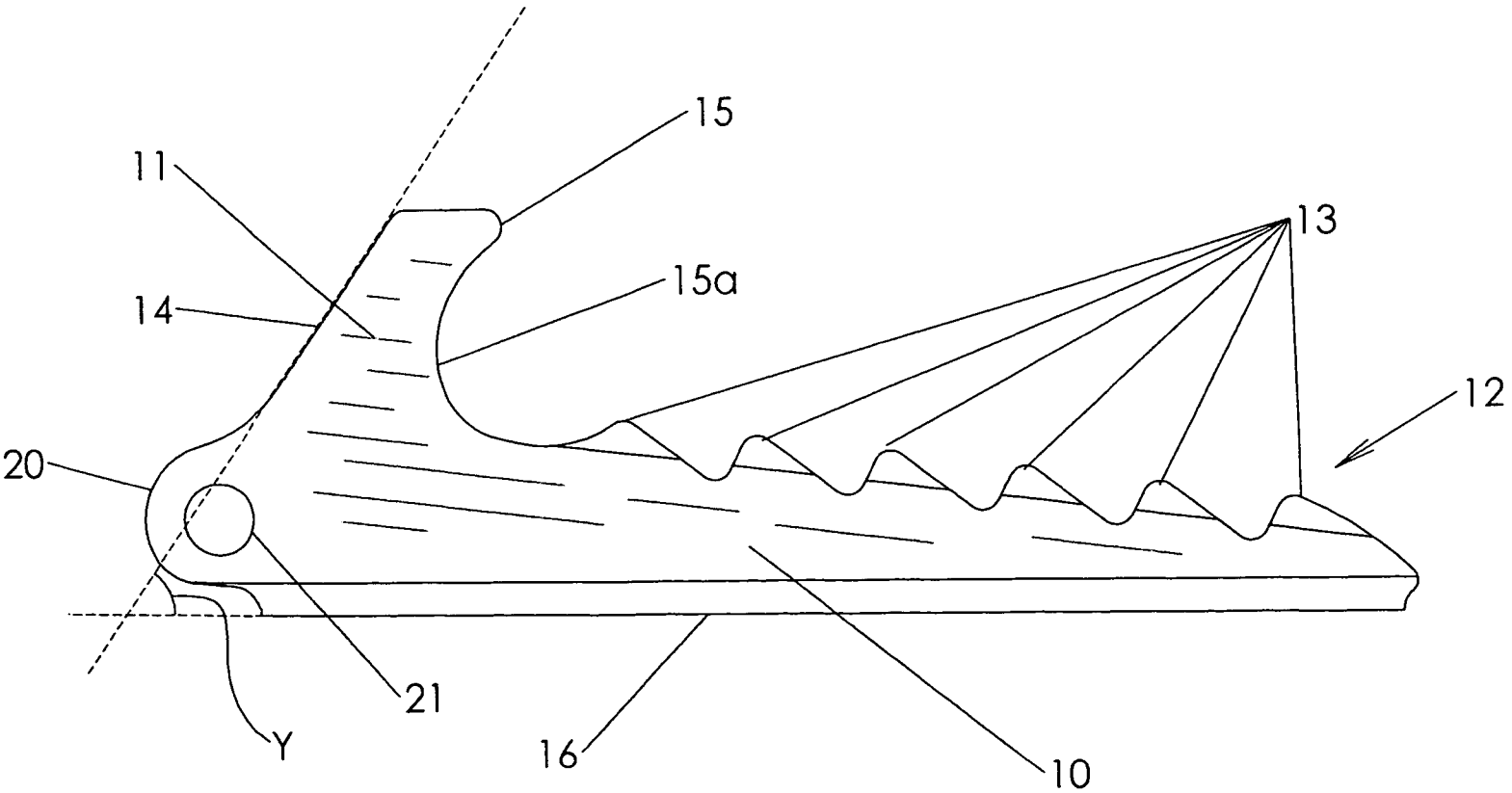
FIG. 10 is a side view of a single blade of the present invention.

In a preferred embodiment, the present invention comprises three blades 10 that are rotatably connected to the retention ring 7, as shown in FIG. 5. Each blade 10 comprises a trigger arm 11 located at the base of the blade 10. The outer edge 12 of each blade is preferably comprised of a plurality of teeth 13 that form a serrated edge. Each blade 10 is tapered in width so that it is wider at the base of the blade than at the blade tip (see FIG. 10). Each trigger arm 11 is comprised of a straight bottom edge 14, a tip 15 that represents the outermost point of the trigger arm 11, and an arcuate trough 15*a* that extends from the tip 15 to the base (or proximal end) of the outer edge 12 of the blade 10. Note that the length of the inner edge 16 of the blade 10 is greater than the length of the outer edge 12 of the blade due to the presence of the trigger arm 11 (see FIG. 10). In a preferred embodiment, the length of the bottom edge 14 of the trigger arm 1 is equal to approximately one-third of the length of the inner edge 16 of the blade, as shown in FIG. 10. The blades 10 are held in place with an elastic band 17.

Figure 2:
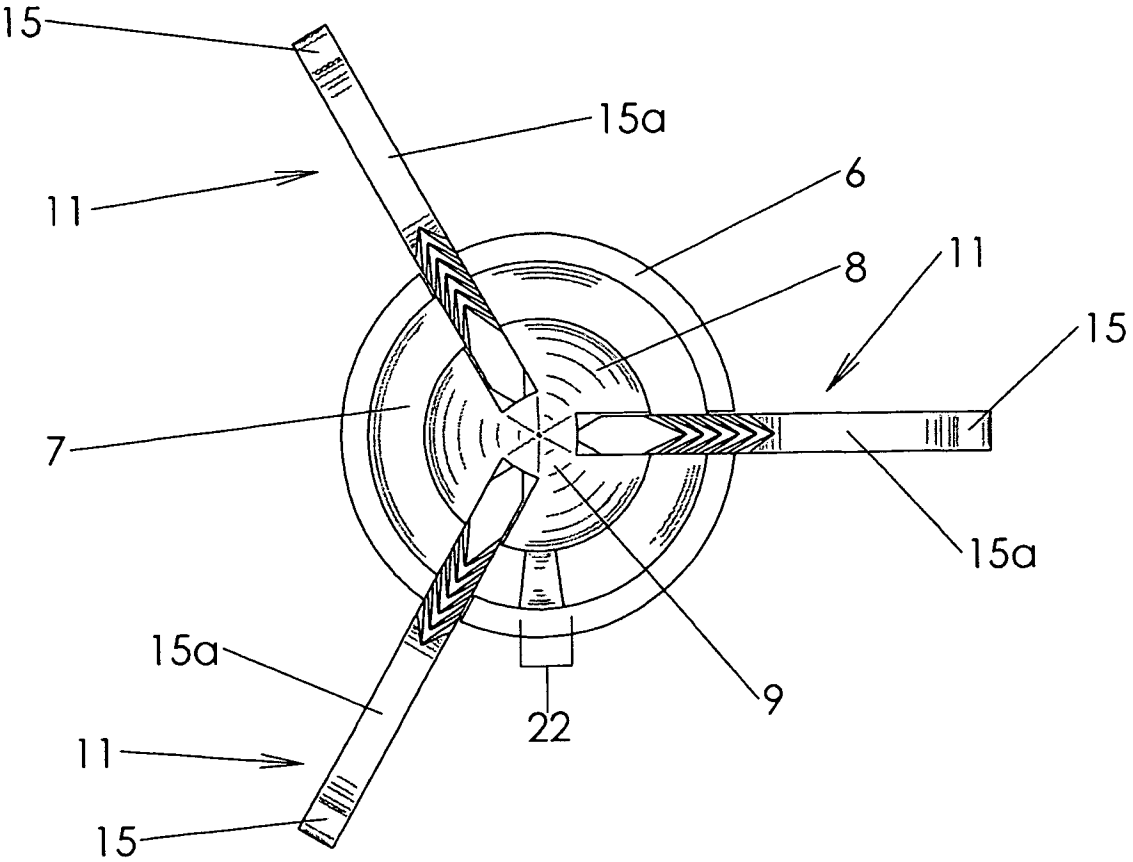
FIG. 2 is a top view of the present invention with the blades in a closed position.

FIG. 2 is a top view of the present invention with the blades in a closed position. As shown in this figure, the blades are preferably oriented circumferentially with one hundred twenty degrees (120°) of separation between them. This figure also clearly shows the retention ring 7 situated within the receptacle 6.

Figure 3:
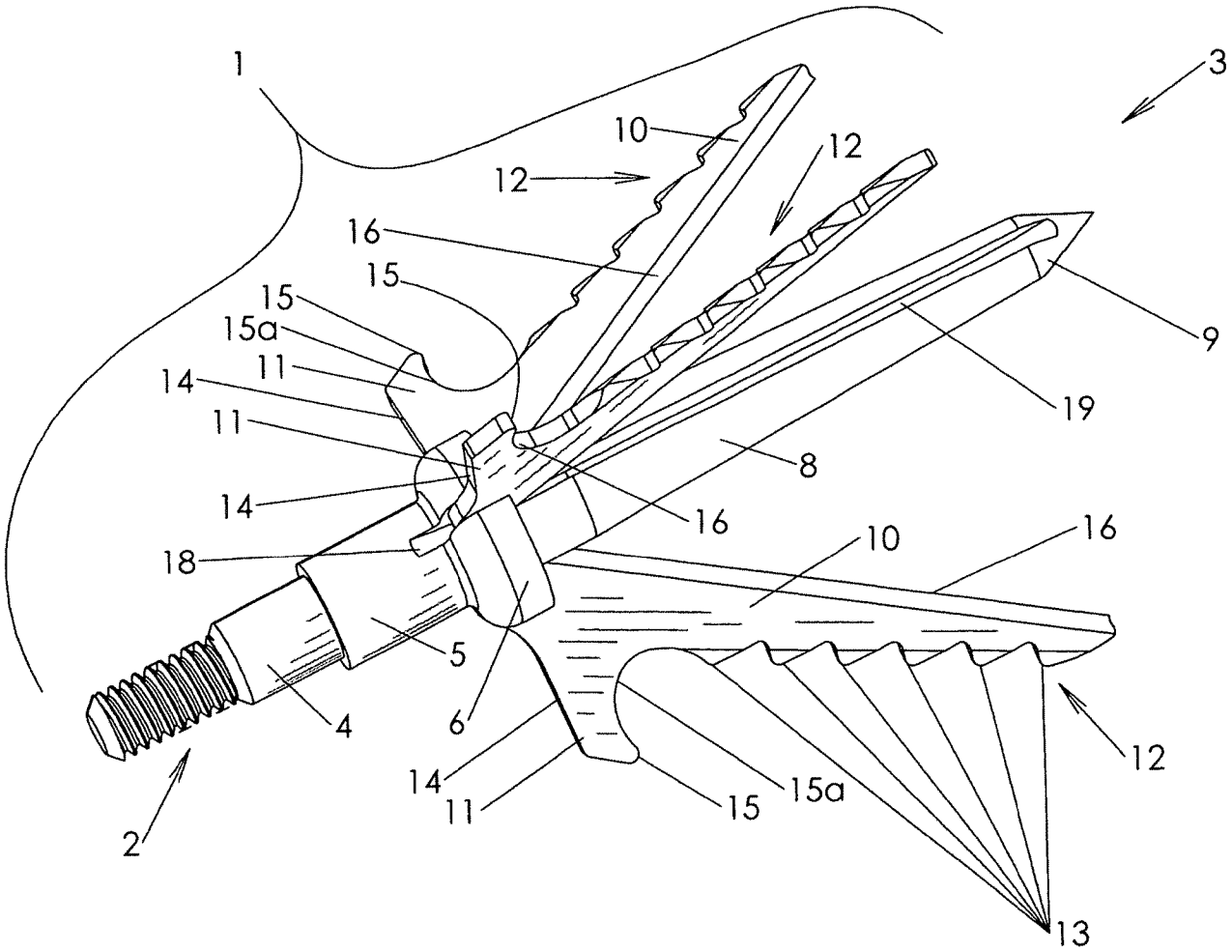
FIG. 3 is a perspective view of the present invention with the blades in a partially open position.
Figure 11:
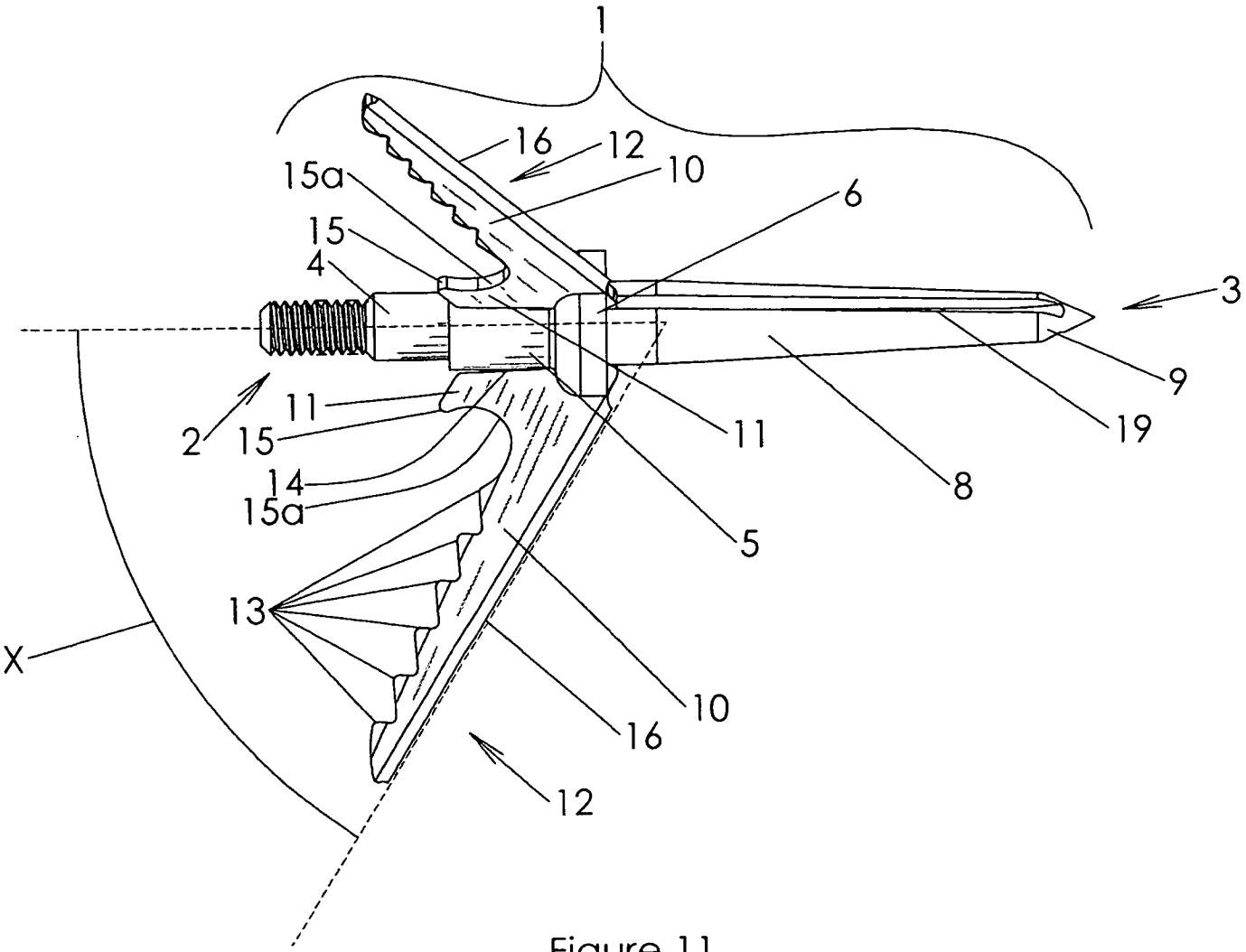
FIG. 11 is a side view of the preset invention with the blades in a fully open position.

FIG. 3 is a perspective view of the present invention with the blades in a partially open position. As shown in this figure, the outer diameter of the second step 5 is greater than the outer diameter of the first step 4, and the length of the second step 5 is approximately 1.5 times that of the first step 4. The receptacle 6 comprises a number of longitudinally extending slots 18; the number of such slots corresponds to the number of blades 10. The slots 18 are configured to allow the blades 10 to rotate outwardly on the retention ring 7 until the bottom edge 14 of the trigger arm 11 hits the second step 5 (see FIG. 4). In the position shown in FIG. 4, the angle of the longitudinal axis of the outer (serrated) edge 12 of the blade 10 relative to the central axis of the shaft 8 is approximately one hundred and thirty-five degrees (135°) (see FIG. 11). FIG. 3 also shows that the top part of the second step 5 preferably comprises an extension of the slot 18 in the receptacle 6 to further accommodate the rotation of the blades 10 on the retention ring 7.

Figure 4:
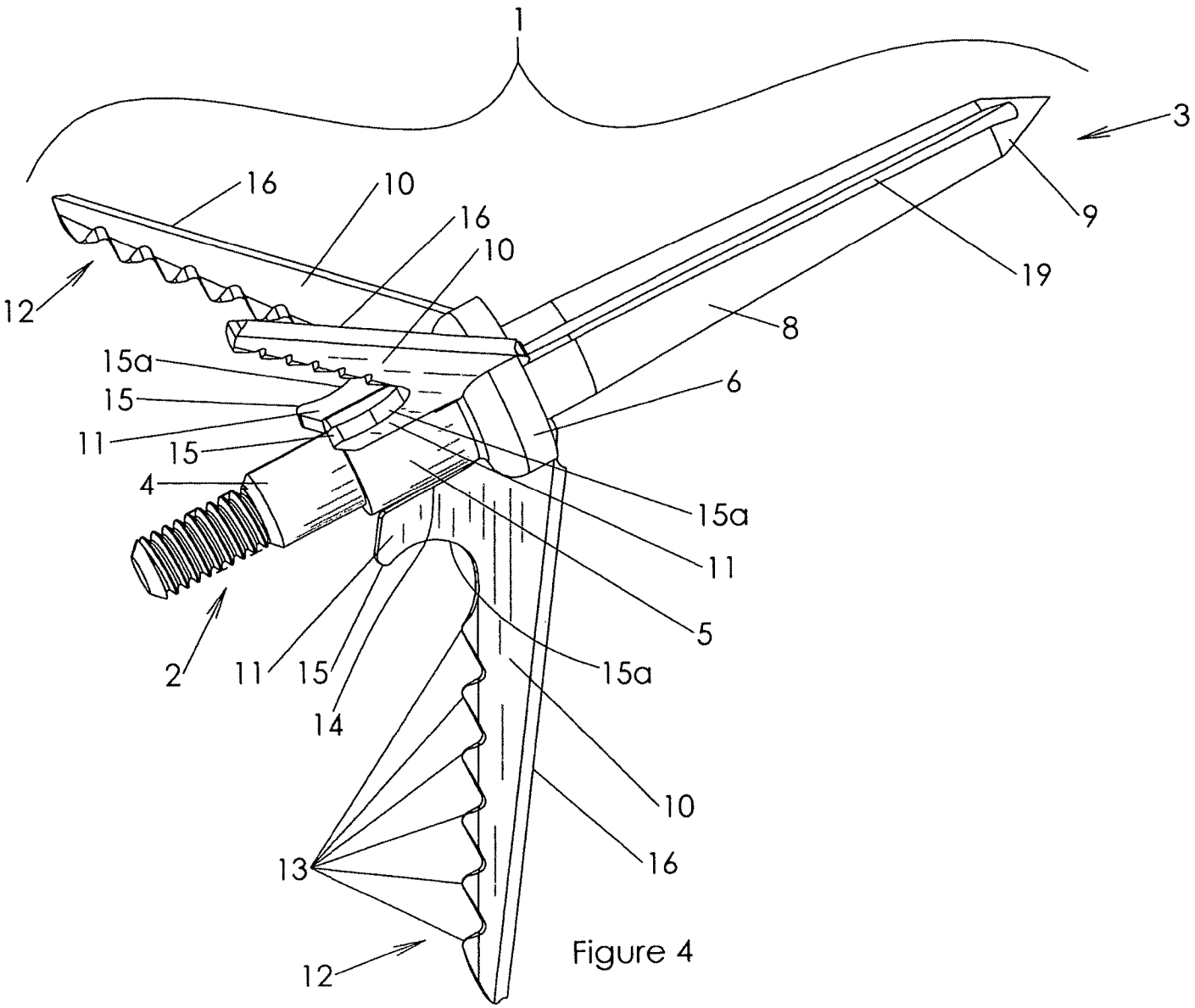
FIG. 4 is a perspective view of the present invention with the blades in a fully open position.

FIG. 4 is a perspective view of the present invention with the blades in a fully open position. As shown in this figure, the inner edge 16 of each of the blades 10 is preferably razor sharp, thereby providing two cutting edges to each blade. When the invention is in a fully open position, the inner edges 16 of the blades 10 are exposed and facing forward (toward the distal end of the arrowhead body). As shown, the shaft 8 comprises a number of longitudinally extending slots 19 or recesses into which the inner edges 16 of the blades 10 fit when the invention is in a closed position. In this manner, the razor sharp edges are only exposed when the trigger arms are activated. Each longitudinally extending slot 19 in the shaft 8 extends from the base of the shaft 8 at the retention ring 7 to the pointed tip 9 of the distal end 3 of the arrowhead body 1. Each blade 10 preferably terminates short of the proximal end of the pointed tip 9 so that the leading edge of the arrowhead body is the pointed tip 9 and not the distal ends of the blades. In a preferred embodiment, the number of blades 10 is three because each blade must be of a sufficient thickness to form the razor sharp inner edge 16; however, the invention may also be configured with two or four blades.

FIG. 5 is a perspective view of the arrow blades and retention ring of the present invention. As shown in this figure, the bottom end of each blade 10 comprises a rounded end 20 with a hole 21 through which the retention ring 7 extends.

Figure 6:
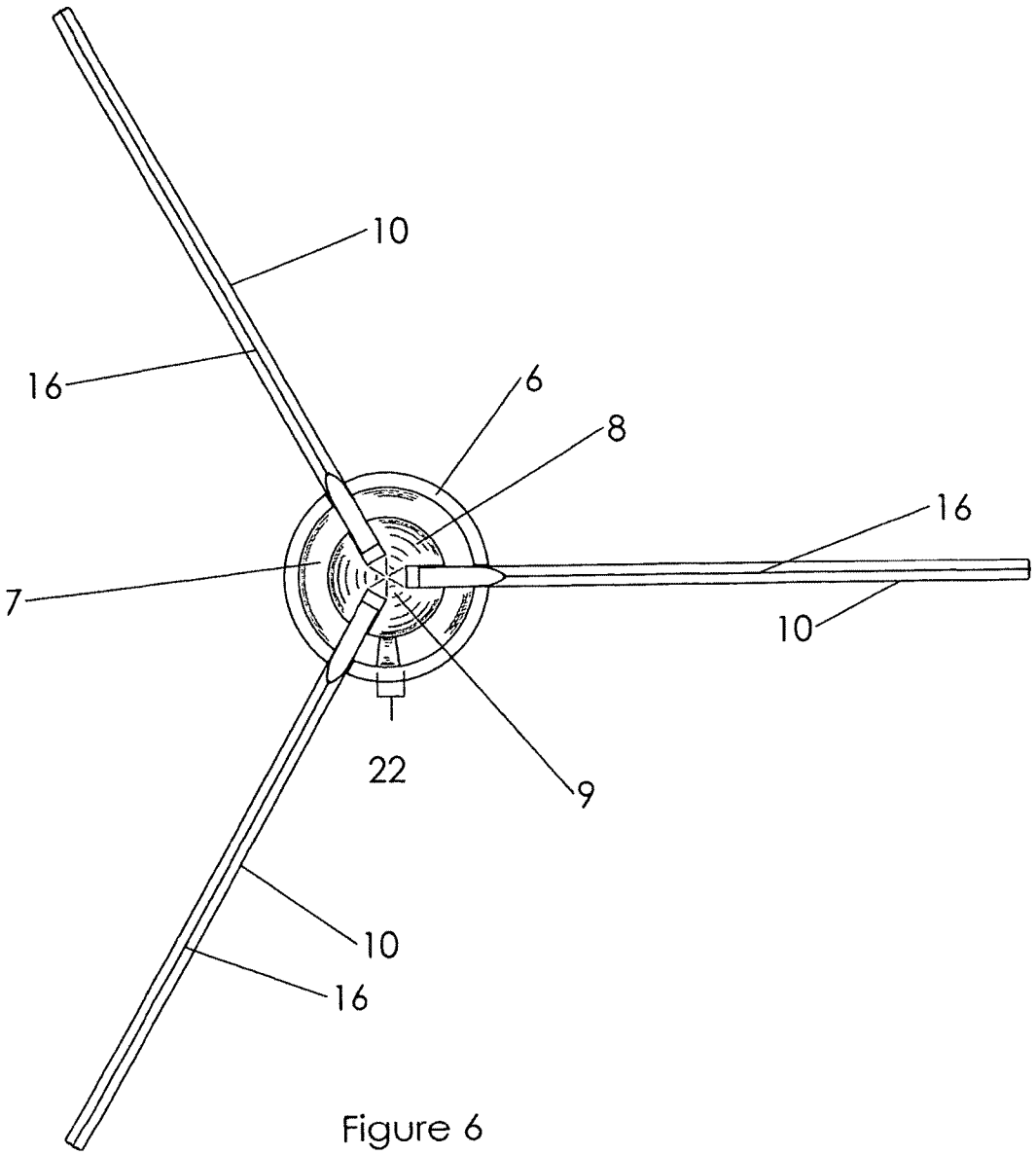
FIG. 6 is a top view of the present invention with the blades in a fully open position.

FIG. 6 is a top view of the present invention with the blades in a fully open position. This view clearly shows the full cutting capacity of the arrowhead when the blades are fully extended and the razor sharp inner edges 16 fully exposed.

Figure 7:
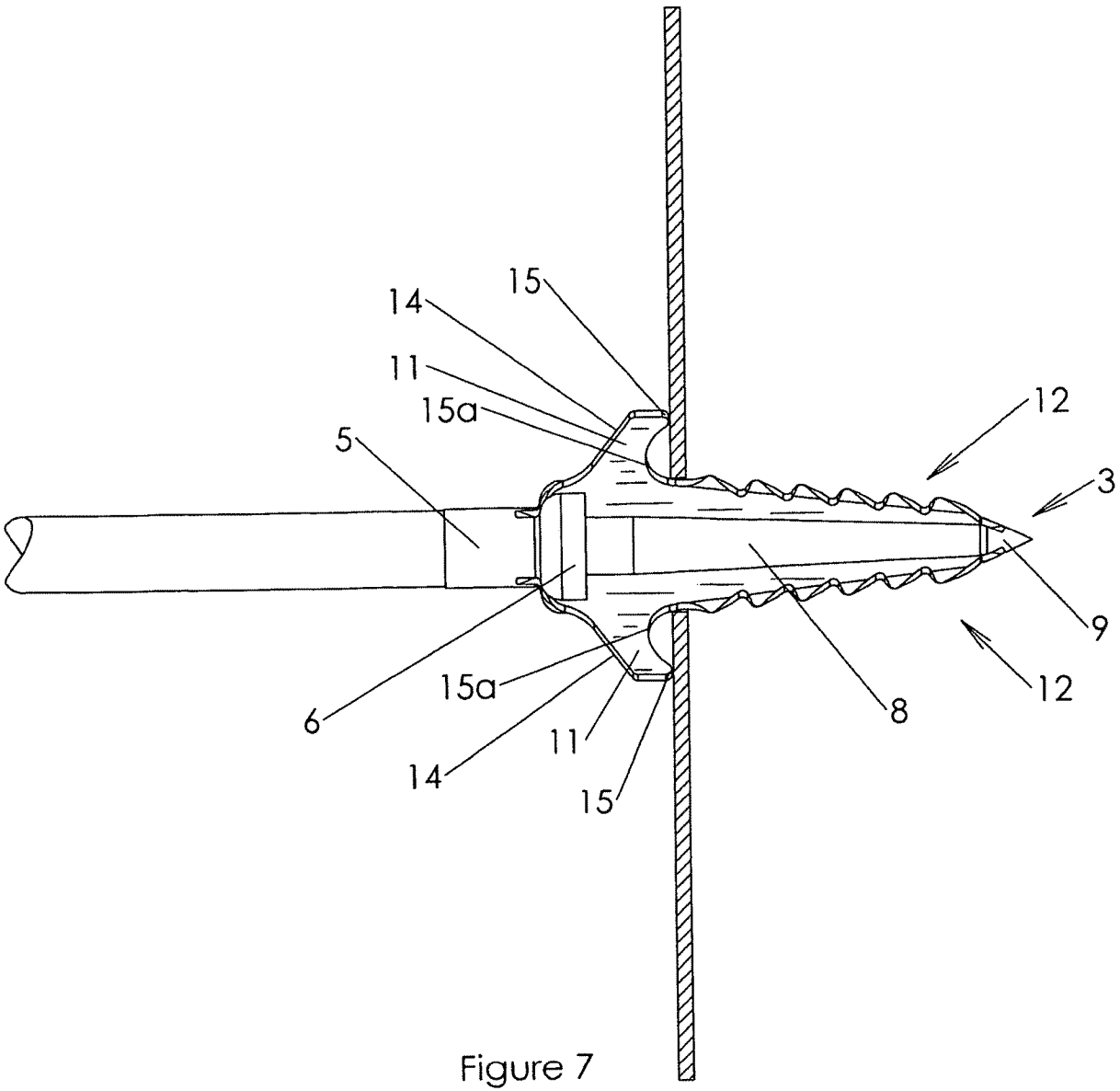
FIG. 7 is a side view of the present invention shown at the point of impact between the trigger arms and the target.

FIG. 7 is a side view of the present invention shown at the point of impact between the trigger arms and the target. As shown in this figure, the pointed tip 9 is the leading edge of the arrowhead body 1 and penetrates the target first. The serrated edges 12 of the blades perform a cutting action as the arrowhead travels further into the target until the point at which the tips 15 of the trigger arms 11 hit the target.

Figure 8:
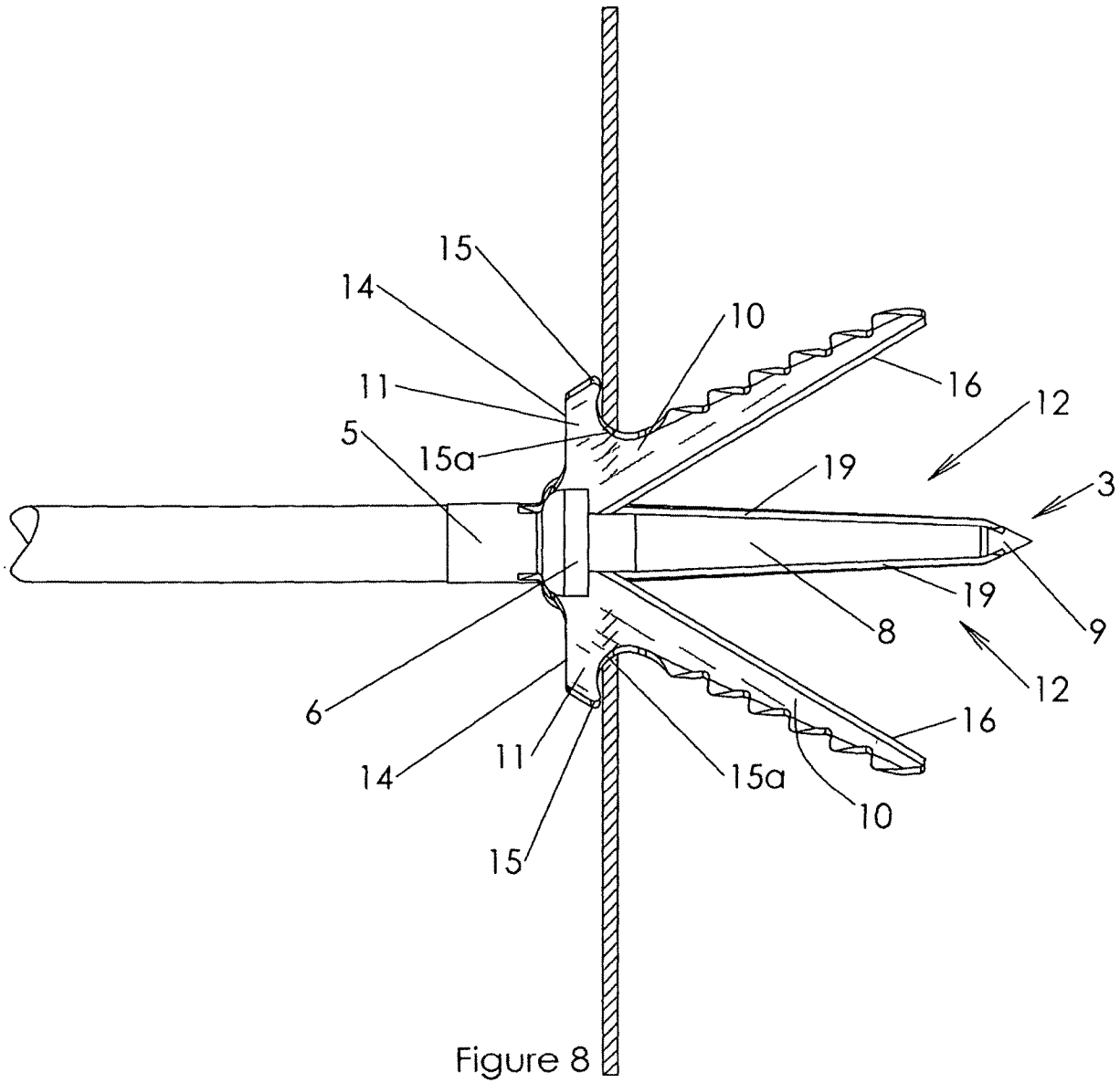
FIG. 8 is a side view of the present invention shown as the blades begin to open within the target.

FIG. 8 is a side view of the present invention shown as the blades begin to open within the target. When the tips 15 of the trigger arms 11 hit the target, the forward momentum of the arrowhead causes the target wall to push against the tips 15, thereby causing the blades 10 to rotate out of the slots 18 in the shaft 8 and extend outward, as shown.

Figure 9:
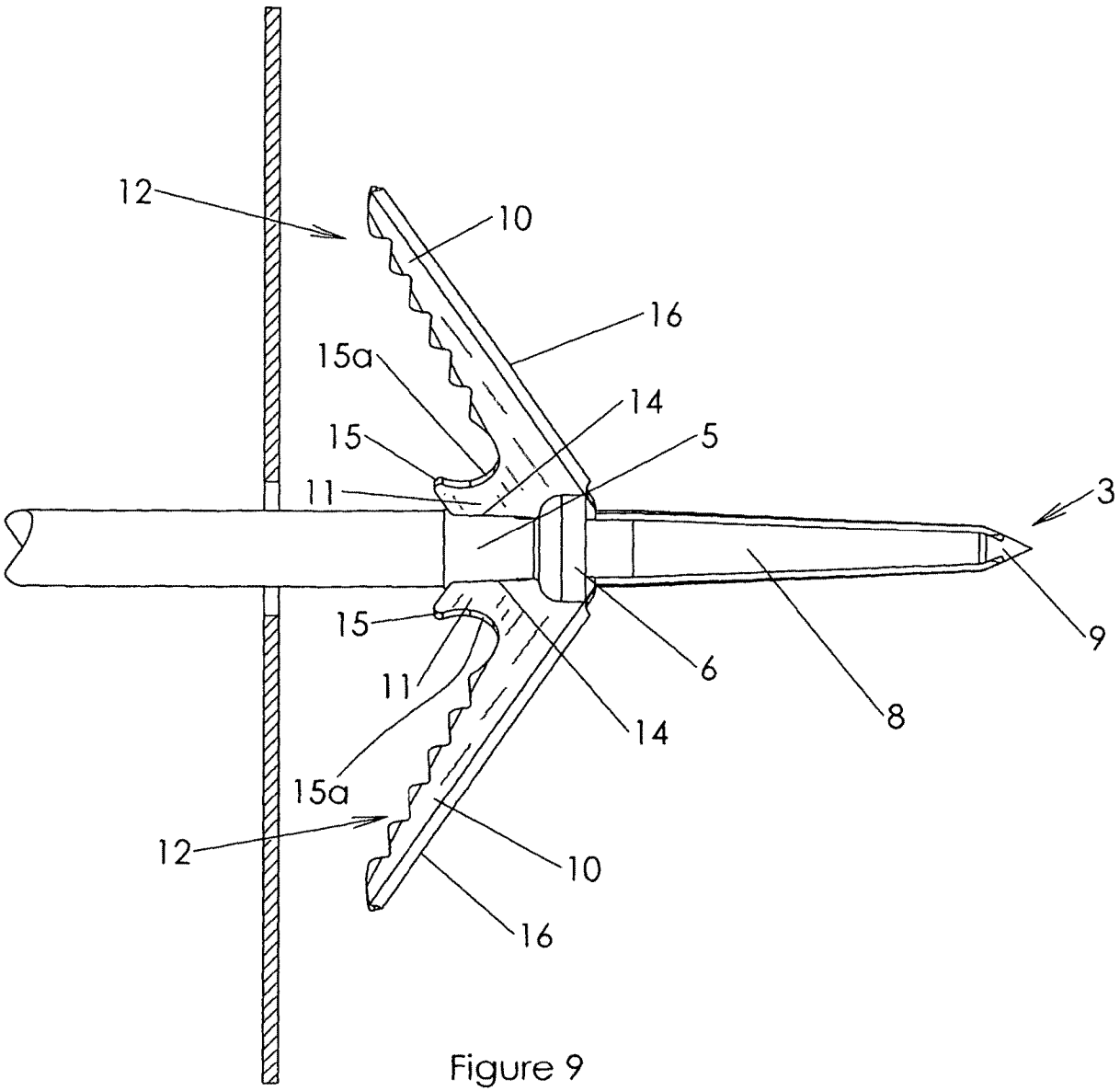
FIG. 9 is a side view of the present invention shown with the present invention fully embedded within the target.

FIG. 9 is a side view of the present invention shown with the present invention fully embedded within the target. As momentum continues to propel the arrowhead forward within the body of the target and the blades open, the target mass presses against the razor sharp inner edges 16 of the blades 10, thereby causing the blades to fully extend to the point at which the bottom edge 14 of the trigger arms 11 hits the second step 5. Note that the first step 4 is no longer visible once the arrowhead is screwed onto an arrow shaft.

FIG. 10 is a side view of a single blade of the present invention. In a preferred embodiment, the angle of the bottom edge 14 of the trigger arm 11 relative to the inner edge 16 of the blade 10 is approximately forty-five degrees (45°). This angle provides the maximum efficacy in terms of the engagement mechanism shown in FIG. 8. Note also that the angle of the bottom edge of the trigger arm 11 relative to the inner edge 16 of the blade 10 is constant, whereas the angle of the bottom edge of the trigger arm 11 relative to the longitudinal axis of the outer (serrated) edge 12 of the blade 10 increases from the proximal (trigger arm) end of the blade to the tip of the blade as the width of the blade decreases and the blade tapers to a point.

Although the figures show a blade 10 with a serrated outer edge 12 and a razor sharp inner edge 16, the retention ring 7 and receptacle 6 configuration of the present invention may be utilized with other kinds of blades. The retention ring 7 provides a common pivot point for the blades 10 and ensures that all of the blades open at the same time and to the same extent, i.e., simultaneously and symmetrically. With its double cutting edges (inner and outer), the present invention provides a larger impact cutting area than conventional arrowhead designs. The serrated outer edge in particular enhances target penetration.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A broadhead arrow comprising:

(a) an arrowhead body with a threaded proximal end and a pointed distal end;

(b) a circumferential receptacle that is situated between the proximal and distal ends of the arrowhead body and configured to receive a retention ring;

(c) a plurality of blades, each blade having a serrated outer edge and a razor sharp inner edge; and (d) a tapered shaft that extends from a center of the retention ring to the pointed distal end;

wherein each blade is rotatably attached to the retention ring;

wherein each blade comprises a trigger arm that is located at a base of the blade;

wherein the shaft comprises a plurality of longitudinally extending slots configured to receive the inner edges of the blades; and wherein the receptacle comprises a number of longitudinally extending slots that are configured to allow the blades to rotate outwardly on the retention ring.

2. The broadhead arrow of claim 1, wherein the serrated outer edge of each blade comprises a plurality of teeth.

3. The broadhead arrow of claim 1, wherein each trigger arm comprises a straight bottom edge, a tip, and an arcuate trough that extends from the tip of the trigger arm to a base of the outer edge of the blade.

4. The broadhead arrow of claim 1, wherein the proximal end of the arrowhead body is threaded;

wherein the arrowhead body further comprises a first raised step and a second raised step;

wherein each of the first raised step and the second raised step has an outer diameter;

wherein the outer diameter of the second raised step is greater than the outer diameter of the first raised step;

wherein the first raised step is situated between the threaded proximal end and the second raised step; and wherein the second raised step terminates in the circumferential receptacle.

5. The broadhead arrow of claim 1, wherein each blade has a tip;

wherein each blade has a width; and wherein the width of each blade is tapered so that the blade is wider at the base of the blade than at the tip of the blade.

6. The broadhead arrow of claim 1, wherein each longitudinally extending slot in the shaft extends from a base of the shaft at the retention ring to the pointed distal end of the arrowhead body.

7. The broadhead arrow of claim 1, wherein the arrowhead body has a leading edge;

wherein the pointed distal end of the arrowhead body has a proximal end and a distal end; and wherein each blade terminates short of the proximal end of the pointed distal end of the arrowhead body so that the pointed distal end of the arrowhead body is the leading edge of the arrowhead body.

8. The broadhead arrow of claim 1, wherein each blade comprises a rounded bottom end with a hole through which the retention ring extends.

9. The broadhead arrow of claim 1, wherein the bottom edge of the trigger arm is at a constant forty-five degree angle relative to the inner edge of the blade.

10. The broadhead arrow of claim 1, wherein each blade has a width that decreases from the base of the blade to the tip of the blade;

wherein there is an angle between the bottom edge of the trigger arm and a longitudinal axis of the outer edge of the blade; and wherein the angle between the bottom edge of the trigger arm and the longitudinal axis of the outer edge of the blade increases from the base of the blade to the tip of the blade as the width of the blade decreases and the blade tapers to a point.

11. A broadhead arrow comprising:

(a) an arrowhead body with a threaded proximal end and a pointed distal end;

(b) a circumferential receptacle that is situated between the proximal and distal ends of the arrowhead body and configured to receive a retention ring;

(c) a plurality of blades, each blade having an outer edge and an inner edge; and (d) a tapered shaft that extends from a center of the retention ring to the pointed distal end;

wherein each blade is rotatably attached to the retention ring;

wherein each blade comprises a trigger arm that is located at a base of the blade;

wherein the shaft comprises a plurality of longitudinally extending slots configured to receive the inner edges of the blades; and wherein the receptacle comprises a number of longitudinally extending slots that are configured to allow the blades to rotate outwardly on the retention ring.

12. The broadhead arrow of claim 11, wherein each trigger arm comprises a straight bottom edge, a tip, and an arcuate trough that extends from the tip of the trigger arm to a base of the outer edge of the blade.

13. The broadhead arrow of claim 11, wherein the proximal end of the arrowhead body is threaded;

wherein the arrowhead body further comprises a first raised step and a second raised step;

wherein each of the first raised step and the second raised step has an outer diameter;

wherein the outer diameter of the second raised step is greater than the outer diameter of the first raised step;

wherein the first raised step is situated between the threaded proximal end and the second raised step; and wherein the second raised step terminates in the circumferential receptacle.

14. The broadhead arrow of claim 11, wherein each blade has a tip;

wherein each blade has a width; and wherein the width of each blade is tapered so that the blade is wider at the base of the blade than at the tip of the blade.

15. The broadhead arrow of claim 11, wherein each longitudinally extending slot in the shaft extends from a base of the shaft at the retention ring to the pointed distal end of the arrowhead body.

16. The broadhead arrow of claim 11, wherein the arrowhead body has a leading edge;

wherein the pointed distal end of the arrowhead body has a proximal end and a distal end; and wherein each blade terminates short of the proximal end of the pointed distal end of the arrowhead body so that the pointed distal end of the arrowhead body is the leading edge of the arrowhead body.

17. The broadhead arrow of claim 11, wherein each blade comprises a rounded bottom end with a hole through which the retention ring extends.

18. The broadhead arrow of claim 11, wherein the bottom edge of the trigger arm is at a constant forty-five degree angle relative to the inner edge of the blade.

19. The broadhead arrow of claim 11, wherein each blade has a width that decreases from the base of the blade to the tip of the blade;

wherein there is an angle between the bottom edge of the trigger arm and a longitudinal axis of the outer edge of the blade; and wherein the angle between the bottom edge of the trigger arm and the longitudinal axis of the outer edge of the blade increases from the base of the blade to the tip of the blade as the width of the blade decreases and the blade tapers to a point.

* * * * *